US010020128B2

(12) United States Patent
Park

(10) Patent No.: US 10,020,128 B2
(45) Date of Patent: Jul. 10, 2018

(54) STRUCTURE OF CONTACTS FOR AIR CIRCUIT BREAKER

(71) Applicant: LSIS CO., LTD., Anyang-si, Gyeonggi-do (KR)

(72) Inventor: Woojin Park, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/333,064

(22) Filed: Oct. 24, 2016

(65) Prior Publication Data

US 2017/0186562 A1 Jun. 29, 2017

(30) Foreign Application Priority Data

Dec. 28, 2015 (KR) ..... 10-2015-0187788

(51) Int. Cl.
*H01H 1/06* (2006.01)
*H01H 1/22* (2006.01)
(Continued)

(52) U.S. Cl.
CPC ..... *H01H 1/06* (2013.01); *H01H 1/221* (2013.01); *H01H 1/50* (2013.01); *H01H 9/30* (2013.01);
(Continued)

(58) Field of Classification Search
CPC ..... H01H 11/0006; H01H 1/54; H01H 2009/305; H01H 33/08; H01H 71/0235; H01H 71/10; H01H 73/18; H01H 77/107
(Continued)

(56) References Cited

U.S. PATENT DOCUMENTS 4,546,220 A 10/1985 Mostosi
2004/0001297 A1 1/2004 Godesa
(Continued)

FOREIGN PATENT DOCUMENTS

CN 201725745 U 1/2011
JP S5468164 U 10/1952
(Continued)

OTHER PUBLICATIONS

Korean Intellectual Property Office Application No. 10-2015-0187788, Office Action dated Nov. 29, 2016, 5 pages.
(Continued)

*Primary Examiner* — Ahmed Saeed
(74) *Attorney, Agent, or Firm* — K&L Gates LLP

(57) ABSTRACT

The present invention relates to a structure of contacts for an air circuit breaker, in which a movable contact arm can be stably brought into contact with a fixed contact arm by changing an applying direction of an electromagnetic repulsive force generated between a movable contact and a fixed contact, and, to this end, the structure, which includes the fixed contact arm having the fixed contact, and the movable contact arm having the movable contact and rotatably installed to be brought into contact with or separated from the fixed contact arm, is configured such that the fixed contact and the movable contact have contact surfaces, respectively, disposed in an inclined manner, and a line commonly passing the contact surfaces of the fixed contact and the movable contact forms an acute angle with respect to a line passing through a center of a longitudinal axis of the movable contact arm.

2 Claims, 8 Drawing Sheets

(51) Int. Cl.

| | |
|---|---|
| ***H01H 9/30*** | (2006.01) |
| ***H01H 33/04*** | (2006.01) |
| ***H01H 73/18*** | (2006.01) |
| ***H01H 1/50*** | (2006.01) |
| ***H01H 77/10*** | (2006.01) |

(52) U.S. Cl.
CPC ..... *H01H 33/04* (2013.01); *H01H 73/18* (2013.01); *H01H 77/101* (2013.01)

(58) Field of Classification Search
USPC .. 200/323, 50.24, 400, 321, 17 R, 250, 275, 200/411, 424
See application file for complete search history.

(56) References Cited

U.S. PATENT DOCUMENTS

| | | | |
|---|---|---|---|
| 2009/0256659 | A1 | 10/2009 | Rane |
| 2014/0305906 | A1 | 10/2014 | Baek |

FOREIGN PATENT DOCUMENTS

| | | |
|---|---|---|
| JP | S5600017 U | 6/1954 |
| JP | S60042251 | 3/1985 |
| JP | S61214313 | 9/1986 |
| JP | H01159926 | 6/1989 |
| JP | H10223115 | 8/1998 |
| JP | 2003022739 | 1/2003 |
| JP | 2003504801 | 2/2003 |
| JP | 2009021243 | 1/2009 |
| JP | 2009134995 | 6/2009 |
| JP | 2009259827 | 11/2009 |
| JP | 2012094341 | 5/2012 |
| KR | 100701775 | 3/2007 |
| KR | 1020090109482 | 10/2009 |

OTHER PUBLICATIONS

European Patent Office Application Serial No. 16189442.3, Search Report dated May 4, 2017, 8 pages.

Korean Intellectual Property Office Application No. 10-2015-0187788, Office Action dated Jun. 28, 2017, 5 pages.

Japanese Office Action for related Japanese Application No. 2016-199790; dated Oct. 31, 2017; (2 pages).

Chinese Office Action for related Chinese Application No. 201611237048.X action dated Apr. 20, 2018; (8 pages).

STRUCTURE OF CONTACTS FOR AIR CIRCUIT BREAKER

CROSS-REFERENCE TO RELATED APPLICATION

Pursuant to 35 U.S.C. § 119(a), this application claims the benefit of an earlier filing date and right of priority to Korean Patent Application No. 10-2015-0187788, filed on Dec. 28, 2015, the contents of which are all hereby incorporated by reference herein in its entirety.

BACKGROUND OF THE INVENTION

1. Field of the Invention

This specification relates to a structure of contacts for an air circuit breaker, and more particularly, a structure of contacts for an air circuit breaker, in which a movable contact arm can stably be brought into contact with a fixed contact arm by changing an electromagnetic repulsive force generated between a movable contact and a fixed contact.

2. Background of the Invention

In general, an air circuit breaker is a circuit breaker which is installed on a top of a low pressure power distribution system, and has functions of maintaining a conductive state for a preset time when a fault current is generated on a circuit due to short-circuit, overload, electric leakage, etc. and breaking the circuit when the fault current remains after the preset time.

FIG. 1A is a schematic view illustrating a separate state between contacts of an air circuit breaker according to the related art, and FIG. 1B is a schematic view illustrating a contact state between the contacts of the air circuit breaker according to the related art.

As illustrated in FIGS. 1A and 1B, the air circuit breaker 100 according to the related art includes a fixed contact arm assembly 20, a movable contact arm assembly 30 relatively movable with respect to the fixed contact arm assembly 20, a switching mechanism 40 for relatively moving the movable contact arm assembly 30 with respect to the fixed contact arm assembly 20, and an arc-extinguishing unit 50 for extinguishing arc generated during opening or closing of the air circuit breaker 10.

The fixed contact arm assembly 20 includes an upper terminal 21 connected to a power source side circuit, a fixed contact arm 22 fixed to the upper terminal 21 to receive power, and a fixed contact 23 provided on the fixed contact arm 22.

The movable contact arm assembly 30 includes a lower terminal 31 connected to a load side circuit (not illustrated), an connect terminal 31*a* disposed on the lower terminal 31, a cage 32 made of an insulating material and having one end rotatably installed on an air circuit breaker housing (not illustrated) through a rotation shaft 38, a movable contact arm 33 disposed on the cage 32 to be rotatable centering on the rotation shaft 38, a contact spring 34 disposed between the movable contact arm 33 and the cage 32 to press the movable contact arm 33 toward the fixed contact arm 22, a movable contact 35 disposed on the movable contact arm 33 and brought into contact with the fixed contact 23 when the movable contact arm 33 is rotated toward the fixed contact arm 22, a wire 36 provided between the movable contact arm 33 and the connect terminal 31*a* to allow a current flow between the movable contact arm 33 and the connect terminal 31*a*, and a link 37 having one end connected to the cage 32 and another end rotatably connected to the switching mechanism 40.

The switching mechanism 40 is a mechanical device that applies a driving force through the link 37 such that the movable contact 35 provided on the movable contact arm 33 is brought into contact with or separated from the fixed contact 23 provided on the fixed contact arm 22.

The arc-extinguishing unit 50 includes a plurality of grids (not illustrated) disposed between the fixed contact 23 and the movable contact 35 (hereinafter, the term "contact" is also used with respect to the fixed contact and the movable contact for the sake of representation) to extinguish arc which is generated between the fixed contact 23 and the movable contact 35 when the movable contact 35 is brought into contact with the fixed contact 23, or specifically, separated from the fixed contact 23, and an arc runner 51 disposed on the fixed contact arm 22 to induce the arc generated between the fixed contact 23 and the movable contact 35 toward the arc-extinguishing unit 50.

Hereinafter, a closing operation of the air circuit breaker 10 having the configuration will be described with reference to FIGS. 1A and 1B.

During a closing operation of the air circuit breaker 10, the switching mechanism 40 rotates the cage 32 illustrated in FIG. 1A through the link 37 in a counterclockwise direction centering on the rotation shaft 39.

When the cage 32 is rotated in the counterclockwise direction, the movable contact arm 33 which is rotatably disposed on the cage 32 is rotated in the counterclockwise direction centering on the rotation shaft 38. Afterwards, a contact surface 35*s* of the movable contact 35 is brought into contact with a contact surface 23*s* of the fixed contact 23, and thereby the rotation of the movable contact arm 33 is stopped.

However, the cage 32 is more rotated in the counterclockwise direction by a preset range due to the switching mechanism 40. Accordingly, as illustrated in FIG. 1B, the contact spring 34 disposed between the movable contact arm 33 and the cage 32 is compressed.

The compressed contact spring 34 elastically presses the contact surface 35*s* of the movable contact 35 of the movable contact arm 33 onto the contact surface 23*s* of the fixed contact 23, and accordingly, a current flows between the fixed contact 23 and the movable contact 35.

In the air circuit breaker 10 having such construction and performing the closing operation, while the current flows between the movable contact 35 and the fixed contact 23 in response to the movable contact 35 being brought into contact with the fixed contact 23, a direction of a current that flows from the contact surface 23*s* of the fixed contact 23 and a direction of a current that flows to the contact surface 35*s* of the movable contact 35 are opposite to each other. Accordingly, an electromagnetic repulsive force is applied between the fixed contact 23 and the movable contact 35.

The electromagnetic repulsive force tries to rotate the movable contact arm 33 in a clockwise direction (i.e., a breaking direction) through the movable contact 35 centering on the rotation shaft 38, but a load of the contact spring 34 is applied opposite to the electromagnetic repulsive force, which results in maintaining the contact state between the contacts 23 and 35.

However, when a great electromagnetic repulsive force is generated between the contacts 23 and 35 due to a heavy current such as a fault current or abnormal current, the electromagnetic repulsive force becomes stronger than the load of the contact spring 34 and thereby rotates the movable contact arm 33 in the clockwise direction. This may be likely to separate the movable contact 35 from the fixed contact 23.

However, the air circuit breaker 10 is the circuit installed on the top of the low pressure distribution system. Thus, in order to ensure a time for a lower circuit breaker (not illustrated) located on a lower circuit to perform a breaking operation although such great electromagnetic repulsive force is generated between the contact 23 and 35 due to the heavy current such as the fault current or the abnormal current, it is required to maintain the contact state between the contacts 23 and 35 for a predetermined time (typically, 1 to 3 seconds).

If the contacts 23 and 35 of the air circuit breaker 10 are separated from each other by the electromagnetic repulsive force generated due to the fault current or abnormal current, a fault may be likely to happen in the lower circuit of the air circuit breaker 10.

Therefore, in the related art air circuit breaker 10, the contact spring 34 has no option but to be set to have great loads to sustain the electromagnetic repulsive force due to the fault current or abnormal current, as well as a rated current of the air circuit breaker 10, for a predetermined time.

However, when the contact spring 34 with the great loads is applied to the movable contact arm assembly 30, the loads of a closing spring (not illustrated) applied to the switching mechanism 40 should also increase proportionally. This may, however, bring about various problems, such as an increase in an impact between the contacts 23 and 35, an increase in abrasion between the contacts 23 and 35, a reduction of a number of times of breaking a circuit, degradation of durability of an air circuit breaker mechanism and the like.

SUMMARY OF THE INVENTION

Therefore, to obviate these problems and other drawbacks of the related art, an aspect of the detailed description is to provide a structure of contacts for an air circuit breaker, capable of maintaining a stable contact force between contacts even by using a contact spring with a relatively small load in a manner of minimizing an affection of an electromagnetic repulsive force generated between the contacts of the air circuit breaker.

To achieve these and other advantages and in accordance with the purpose of this specification, as embodied and broadly described herein, there is provided a structure of contacts for an air circuit breaker, the structure including a fixed contact arm having a fixed contact, and a movable contact arm having a movable contact, and rotatably installed to be brought into contact with or separated from the fixed contact arm, wherein the fixed contact and the movable contact have contact surfaces, respectively, that are disposed in an inclined manner, and wherein a line commonly passing the contact surfaces of the fixed contact and the movable contact forms an acute angle with respect to a line passing through a center of a longitudinal axis of the movable contact arm.

Here, the fixed contact may be coupled to a fixed contact sheet that is formed by bending a part of the fixed contact arm, and the movable contact may be coupled to a movable contact sheet that is formed by bending a part of the movable contact arm.

Also, the fixed contact and the movable contact may have the contact surfaces formed in the inclined manner.

The acute angle may be formed in the range of 10° to 40°.

The movable contact arm may be disposed on a cage rotatably installed in a housing. A contact spring may be interposed between the cage and the movable contact arm. The contact spring, the movable contact and a rotation shaft of the movable contact arm may be sequentially arranged in a longitudinal axial direction of the movable contact arm, starting from an end of the movable contact arm.

A structure of contacts for an air circuit breaker according to the present invention may be configured such that contact surfaces of a fixed contact and a movable contact are disposed in an inclined manner and a line commonly passing the contact surfaces of the fixed contact and the movable contact forms an acute angle with respect to a line passing through a center of a longitudinal axis of a movable contact arm. This may more reduce a length of a moment arm of the movable contact arm than that of the related art. Therefore, assuming that the same electromagnetic repulsive force as that of the related art is applied to the movable contact, namely, the movable contact arm, a moment that is substantially applied to the movable contact arm can be reduced.

Therefore, the structure of the contacts for the air circuit breaker according to the present invention can maintain the contact state between the fixed and movable contacts more stably than the structure of the contacts for the air circuit breaker according to the related art, although the electromagnetic repulsive force drastically increases due to a generation of a heavy current such as a fault current or abnormal current between the contacts.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given of preferred configurations, with reference to the accompanying drawings, which is to explain in detail enough that those skilled in the art to which the present invention belongs can easily practice the invention. It should not be construed to limit the technical scope and spirits of the present invention.

Figure 2A:
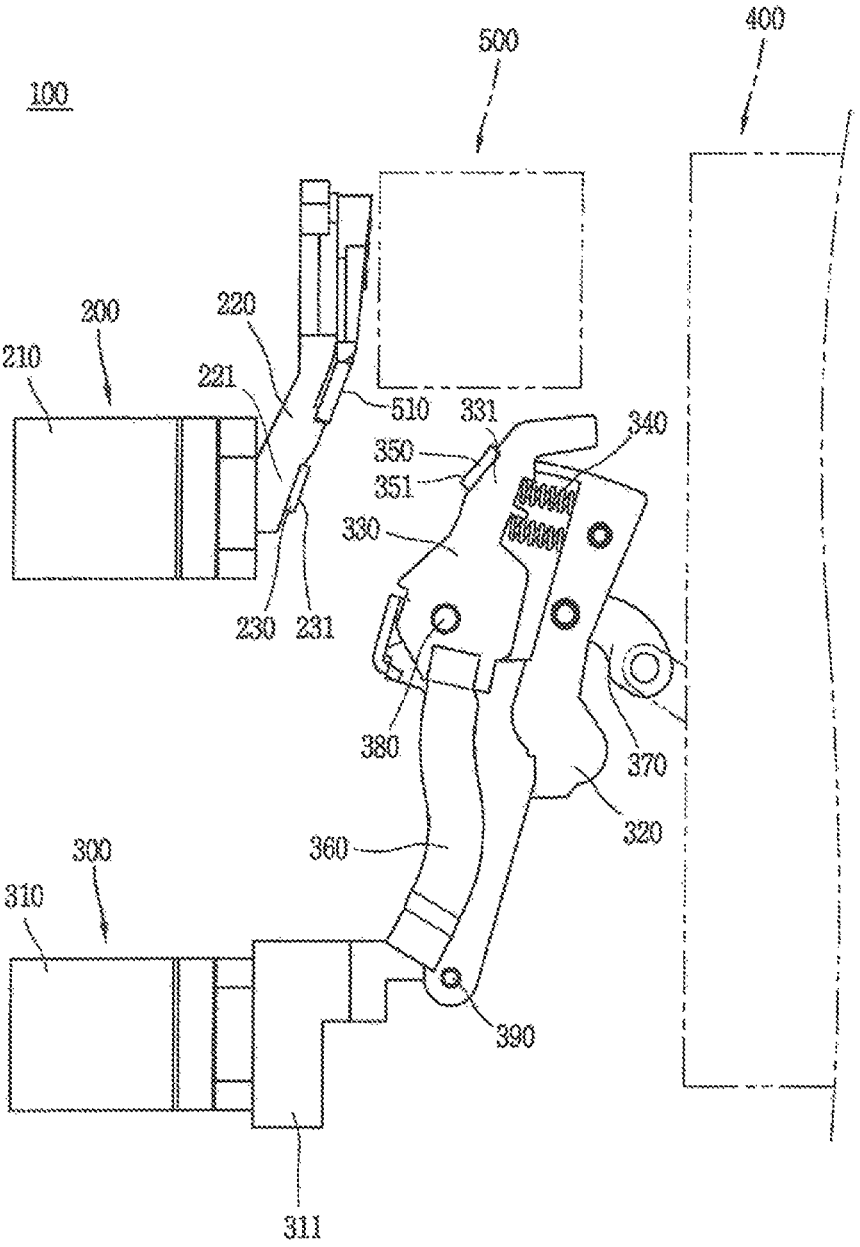
FIG. 2A is a schematic view illustrating a separate state between contacts of an air circuit breaker in accordance with the present invention.
Figure 2B:
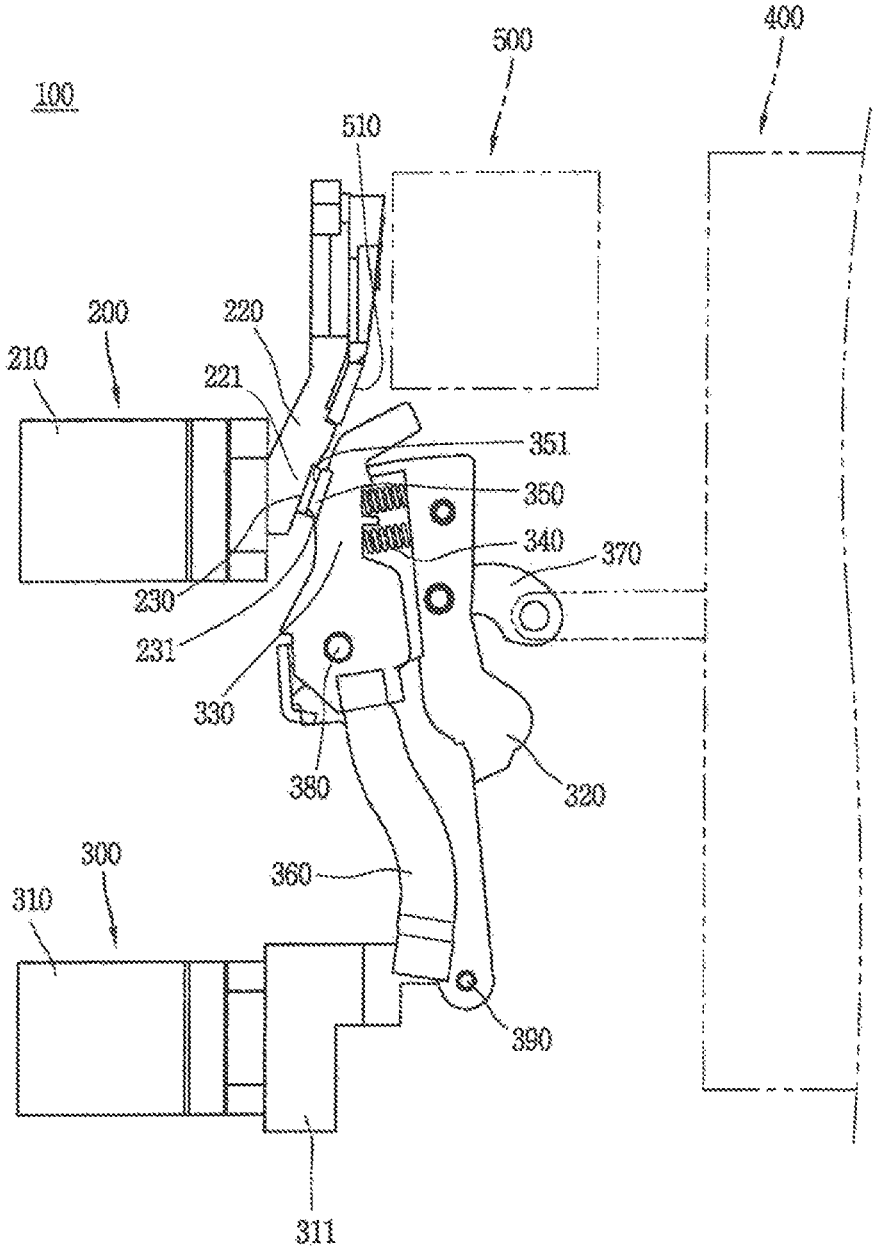
FIG. 2B is a schematic view illustrating a contact state between the contacts of the air circuit breaker in accordance with the present invention.

FIG. 2A is a schematic view illustrating a separate state between contacts of an air circuit breaker in accordance with the present invention, and FIG. 2B is a schematic view illustrating a contact state between the contacts of the air circuit breaker in accordance with the present invention.

As illustrated in FIGS. 2A and 2B, an air circuit breaker 100, to which a structure of contacts for an air circuit breaker according to the present invention is applied includes a fixed contact arm assembly 200, a movable contact arm assembly 300 relatively movable with respect to the fixed contact arm assembly 200, a switching mechanism 400 for relatively moving the movable contact arm assembly 300 with respect to the fixed contact arm assembly 200, and an arc-extinguishing unit 500 for extinguishing arc generated during opening or closing of the air circuit breaker 100.

The fixed contact arm assembly 200 includes an upper terminal 210 connected to a power source side circuit, a fixed contact arm 220 fixed to the upper terminal 210 to receive power, a fixed contact 230 provided on the fixed contact arm 220, and a fixed contact sheet 231 located on the fixed contact arm 220 and having the fixed contact 230 coupled thereto.

The movable contact arm assembly 300 includes a lower terminal 310 connected to a load side circuit (not illustrated), an connect terminal 311 disposed on the lower terminal 310, a cage 320 made of an insulating material and having one end rotatably installed on an air circuit breaker housing (not illustrated) through a rotation shaft 380, a movable contact arm 330 disposed on the cage 320 to be rotatable centering on the rotation shaft 390, a contact spring 340 disposed between the movable contact arm 330 and the cage 320 to press the movable contact arm 330 toward the fixed contact arm 220, a movable contact 350 disposed on the movable contact arm 330 and brought into contact with the fixed contact 230 when the movable contact arm 330 is rotated toward the fixed contact arm 220, a movable contact sheet 331 located on the movable contact arm 330 and having the movable contact 350 coupled thereto, a wire 360 provided between the movable contact arm 330 and the connect terminal 311 to allow a current flow between the movable contact arm 330 and the connect terminal 311, and a link 370 having one end connected to the cage 320 and another end rotatably connected to the switching mechanism 400.

The switching mechanism 400 is a mechanical device that applies a driving force through the link 370 such that the movable contact 350 provided on the movable contact arm 330 is brought into contact with or separated from the fixed contact 230 provided on the fixed contact arm 220.

The arc-extinguishing unit 500 includes a plurality of grids (not illustrated) disposed between the fixed contact 230 and the movable contact 350 to extinguish arc which is generated between the fixed contact 230 and the movable contact 350 when the movable contact 350 is brought into contact with the fixed contact 230, or specifically, separated from the fixed contact 230, and an arc runner 510 disposed on the fixed contact arm 220 to induce the arc generated between the fixed contact 230 and the movable contact 350 toward the arc-extinguishing unit 500.

The air circuit breaker 100 to which the structure of the contacts according to the present invention with the configuration is applied has a similar structure to the related art air circuit breaker 10, except for shapes of the fixed contact 230 and the movable contact 350, and structural shapes of the fixed contact sheet 221 located on the fixed contact arm 220 and having the fixed contact 230 coupled thereto and the movable contact sheet 331 located on the movable contact arm 330 and having the movable contact 350 coupled thereto.

Figures 3A, 3B:
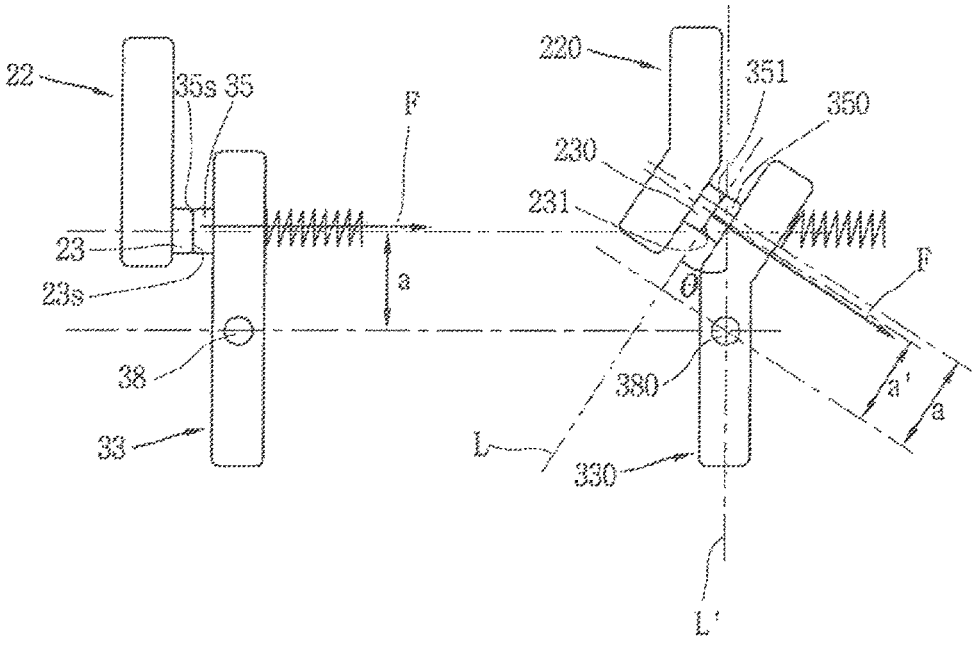
Fig. 3A (Prior Art)
FIGS. 3A and 3B are exemplary views for comparing a moment size by the structure of the contacts of the prior art air circuit breaker (illustrated in FIG. 3A) with a moment size by the structure of the contacts of the air circuit breaker according to the present invention (illustrated in FIG. 3B)

Referring to FIG. 3B, according to the structure of the contacts for the air circuit breaker 100 according to the present invention, contact surfaces 231 and 351 of the fixed contact 230 and the movable contact 350 are disposed in an inclined manner. In more detail, a line L commonly passing the contact surfaces 231 and 351 of the fixed contact 230 and the movable contact 350 is inclined to form an acute angle 8 with respect to a line L' passing through a center of a longitudinal axis of the movable contact arm 330.

When the contact surfaces 231 and 351 of the fixed contact 230 and the movable contact 350 are inclined, a line of action of the electromagnetic repulsive force generated between the contact surfaces 231 and 351 during the closing operation of the air circuit breaker 100 can be moved to be adjacent to the rotation shaft 380 of the movable contact arm 330, which may result in reducing a moment M' that is generated in the movable contact arm 330 due to the electromagnetic repulsive force.

This will now be explained in more detail with reference to FIGS. 3A and 3B.

FIG. 3A illustrates the structure of the contacts for the air circuit breaker 10 according to prior art, and FIG. 3B illustrates the structure of the contacts for the air circuit breaker 100 according to the present invention. In the structure of the contacts according to the present invention, a length of a moment arm a' of the movable contact arm 330, namely, a perpendicular line which is connected from the rotation shaft 380 of the movable contact arm 330 to the line of action of the electromagnetic repulsive force is shorter than a length of a moment arm a of the movable contact arm 33 in the structure of the contacts according to the prior art.

Therefore, when the same electromagnetic repulsive force F is applied to the movable contact arm 330, a magnitude of the moment M' generated in the movable contact arm 330 according to the present invention is smaller than a moment M generated in the movable contact arm 33 according to the related art.

This may be expressed by Formula as follows.

$$M=F\times a \rangle M'=F\times a'$$

A moment reduction effect according to the present invention will be expressed by Formula as follows.

$$M-M'=F\times(a-a')$$

Meanwhile, as can be seen in FIG. 3B, as the acute angle θ becomes larger, the length of the moment arm a' becomes shorter. Accordingly, the rotation moment M' by the electromagnetic repulsive force can be reduced, thereby stably maintaining the contact state of the movable contact 350 with the fixed contact 230.

On the other hand, when the acute angle θ becomes larger (e.g., in the range of 45° to 90°), a slip phenomenon between the contacts 230 and 350 may increase and thereby abrasion between the contacts 230 and 350 may also increase. In addition, when the abrasion between the contacts 230 and 350 reaches a predetermined level, the movable contact 350 may not be supported on the fixed contact 230 but be moved over the fixed contact 230 so as to be separated from the fixed contact 230 in a counterclockwise direction.

This may be likely to cause not only a fault of the air circuit breaker 100 but also a fault of the lower circuit. Therefore, to prevent an occurrence of the problems, the acute angle θ is set in the range of 10° to 40° in the structure of the contacts for the air circuit breaker 100 according to the present invention.

Meanwhile, according to a first embodiment of the structure of the contacts for the air circuit breaker 100 according to the present invention, the fixed contact sheet 221 having the fixed contact 230 coupled thereto and the movable contact sheet 331 having the movable contact 350 coupled thereto may be formed in an inclined manner such that the contact surfaces 231 and 351 of the fixed contact 230 and the movable contact 350 can be inclined, and thereafter the fixed contact 230 and the movable contact 350 may be disposed on the sheets 221 and 331, respectively. Here, the fixed contact sheet 221 and the movable contact sheet 331 may be formed in a manner of bending parts of the fixed contact arm 220 and the movable contact arm 330, respectively. Or, although not illustrated, the fixed contact sheet 221 and the movable contact sheet 331 may be formed in a manner that parts of the fixed contact arm 220 and the movable contact arm 330 protrude in an inclined state.

Figure 4A:
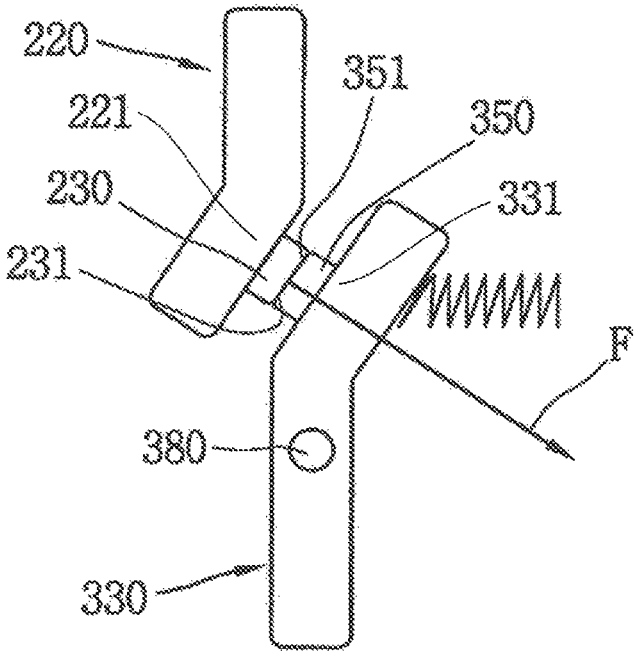
FIG. 4A is an exemplary view illustrating a first embodiment according to the present invention.
Figure 4B:
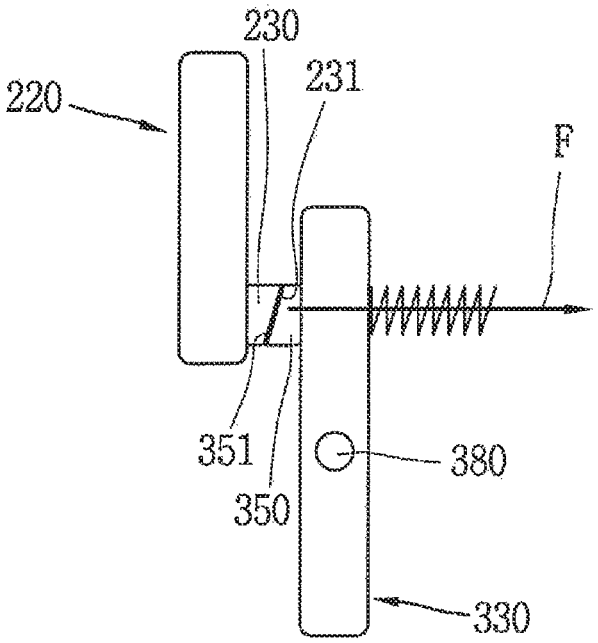
FIG. 4B is an exemplary view illustrating a second embodiment according to the present invention.

Also, according to a second embodiment for arranging the contact surface 231 and 351 of the fixed contact 230 and the movable contact 330 in the inclined state, as illustrated in FIG. 4B, the contact surfaces 231 and 351 of the fixed contact 230 and the movable contact 350 may be formed directly in the inclined state. The second embodiment has the advantage that the structure of the contacts for the air circuit breaker according to the related art can be employed as it is.

Although not illustrated, the structure of the contacts for the air circuit breaker can alternatively be configured in a manner of combining the first and second embodiments.

According to a variation embodiment of the first and second embodiments, the rotation shaft 380 may be disposed further close to the movable contact 350 to reduce the moment M' by the electromagnetic repulsive force, and the contact spring 340 may be disposed further close to a free end side of the movable contact arm 330 to increase a pressing moment by the contact spring 340.

Figure 4C:
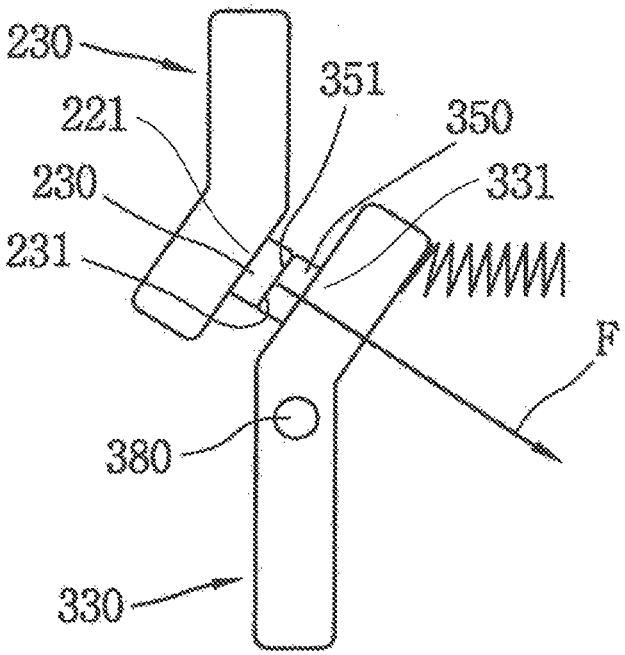
FIG. 4C is an exemplary view illustrating a variation embodiment applicable to the first and second embodiments of the present invention.

In the variation embodiment, as illustrated in FIG. 4C, the contact spring 340, the movable contact 350 and the rotation shaft 380 of the movable contact arm 300 are sequentially disposed in a longitudinal axial direction of the movable contact arm 330, starting from an end of the movable contact arm 330.

FIG. 4C illustrates the example employing the first embodiment, but it is merely illustrative, and alternatively the variation embodiment may employ the second embodiment.

Hereinafter, a closing operation of the air circuit breaker according to the present invention having the configuration will be described with reference to FIGS. 2A to 3.

During a closing operation of the air circuit breaker 100, the switching mechanism 400 rotates the cage 320 illustrated in FIG. 2A in a counterclockwise direction through the link 370 centering on the rotation shaft 380.

When the cage 320 is rotated in the counterclockwise direction, the movable contact arm 330 which is rotatably disposed on the cage 320 is rotated in the counterclockwise direction centering on the rotation shaft 380. Afterwards, the contact surface 351 of the movable contact 350 is brought into contact with the contact surface 231 of the fixed contact 230, and thereby the rotation of the movable contact arm 330 is stopped.

Figure 1A:
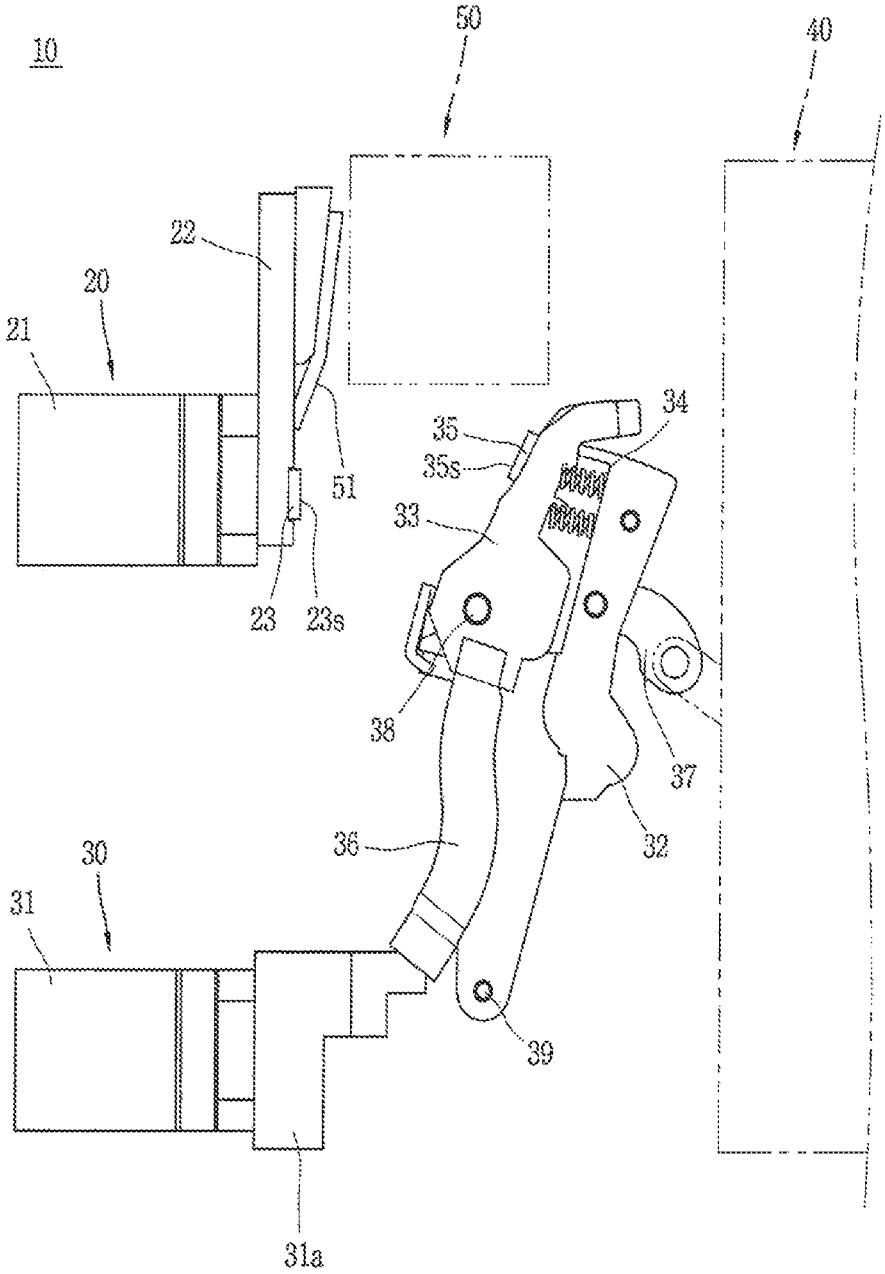
Fig. 1A Prior Art
FIG. 1A is a schematic view illustrating a separate state between contacts of an air circuit breaker according to the related art.
Figure 1B:
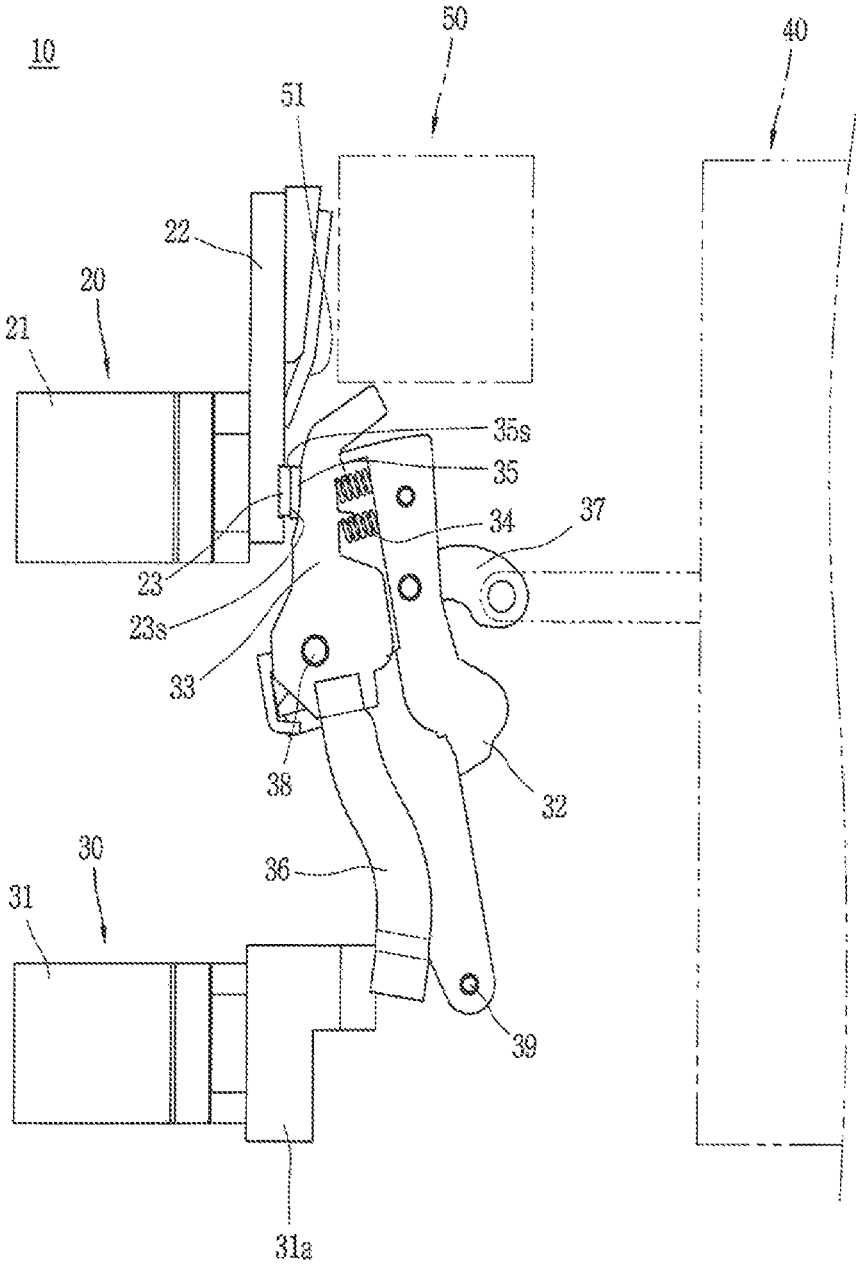
Fig. 1B Prior Art
FIG. 1B is a schematic view illustrating a contact state between the contacts of the air circuit breaker according to the related art.

However, the cage 320 is more rotated in the counterclockwise direction by a preset range due to the switching mechanism 400. Accordingly, as illustrated in FIG. 1B, the contact spring 340 disposed between the movable contact arm 330 and the cage 320 is compressed.

The compressed contact spring 340 elastically presses the contact surface 351 of the movable contact 350 of the movable contact arm 330 onto the contact surface 231 of the fixed contact 230, and accordingly, a current flows between the fixed contact 230 and the movable contact 350.

In the air circuit breaker 100 having such construction and performing the closing operation, while the current flows between the movable contact 350 and the fixed contact 230 in response to the movable contact 350 being brought into contact with the fixed contact 230, a direction of a current that flows from the contact surface 231 of the fixed contact 230 and a direction of a current that flows to the contact surface 351 of the movable contact 350 are opposite to each other. Accordingly, an electromagnetic repulsive force is applied between the fixed contact 230 and the movable contact 350.

The electromagnetic repulsive force tries to rotate the movable contact arm 330 in a clockwise direction (i.e., a breaking direction) through the movable contact 350 centering on the rotation shaft 380. Specifically, when a great electromagnetic repulsive force is generated between the contacts 230 and 350 due to a heavy current such as a fault current or abnormal current, the electromagnetic repulsive force becomes stronger than the load of the contact spring 340 and thereby tries to rotate the movable contact arm 33 in the clockwise direction.

However, the structure of the contacts for the air circuit breaker 100 according to the present invention is configured such that the line which commonly passes the contact surfaces 231 and 351 of the fixed contact 230 and the movable contact 350 forms an acute angle with respect to a line L' passing through a center of a longitudinal axis of the movable contact arm 330. Accordingly, the length of the moment arm a' may become shorter than the length of the moment arm a in the related art. Therefore, assuming that the same electromagnetic repulsive force F, generated due to a fault current or abnormal current, as compared with the related art, is applied to the movable contact arm 330, a reduction of moment (M-M') as much as F×(a-a') is caused in the movable contact arm 330.

Therefore, the structure of the contacts for the air circuit breaker according to the present invention can more stably maintain the contact state between the contacts than the structure of the contacts for the air circuit breaker according to the related art even though the strength of the electromagnetic repulsive force is drastically increased due to a generation of a heavy current, such as a fault current or abnormal current, between the contacts.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A structure of contacts for an aft circuit breaker, the structure comprising:

a fixed contact arm having a fixed contact; and a movable contact arm having a movable contact, and rotatably installed to be brought into contact with or separated from the fixed contact arm, wherein the fixed contact and the movable contact have contact surfaces, respectively, that are disposed in an inclined manner, and wherein a line commonly passing the contact surfaces of the fixed contact and the movable contact forms an acute angle with respect to a line passing through a center of a longitudinal axis of the movable contact arm, wherein the movable contact arm is located on a cage rotatably installed in a housing, wherein a contact spring is interposed between the cage and the movable contact arm, wherein the contact spring, the movable contact and a rotation shaft of the movable contact arm are sequentially arranged in a longitudinal axial direction of the movable contact arm, starting from an end of the movable contact arm, and wherein the contact spring is located perpendicular to the longitudinal axial direction of the movable contact arm, wherein the fixed contact is coupled to a fixed contact sheet that is formed by bending a part of the fixed contact arm, and the movable contact is coupled to a movable contact sheet that is formed by bending a part of the movable contact arm.

2. The structure of claim 1, wherein the acute angle is formed in the range of 10° to 40°.

* * * * *